US005127788A

United States Patent [19]

Schulz

[11] Patent Number: 5,127,788

[45] Date of Patent: Jul. 7, 1992

[54] SYSTEM FOR TRANSPORTING BOBBINS BETWEEN SPINNING MACHINES

[75] Inventor: Gunter Schulz, Ebersbach/Fils, Fed. Rep. of Germany

[73] Assignee: Zinser Textilmaschinen GmbH, Ebersbach/Fils, Fed. Rep. of Germany

[21] Appl. No.: 682,887

[22] Filed: Apr. 8, 1991

Related U.S. Application Data

[63] Continuation-in-part of Ser. No. 572,346, Aug. 23, 1990, abandoned, which is a continuation of Ser. No. 254,469, Oct. 6, 1988, abandoned.

[30] Foreign Application Priority Data

Oct. 9, 1987 [DE] Fed. Rep. of Germany ..... 3734298

[51] Int. Cl.[5] ..... E01B 25/22; B65H 54/26

[52] U.S. Cl. ..... 414/331; 242/35.5 A; 57/90; 57/281; 198/347.4

[58] Field of Search ..... 414/331; 198/347.1, 198/347.4; 57/90, 281; 242/35.5 A, 35.5 R

[56] References Cited

U.S. PATENT DOCUMENTS

| | | | |
|---|---|---|---|
| 2,963,182 | 12/1960 | Geiger | 414/343 |
| 3,788,054 | 1/1974 | Haussmann et al. | 198/347 X |
| 3,828,682 | 8/1974 | Klein | 57/281 X |
| 3,924,762 | 12/1974 | Igel | 414/331 |
| 4,515,328 | 5/1985 | Payne, Jr. | 414/331 X |
| 4,583,358 | 4/1986 | Krieger et al. | 57/281 |
| 4,586,326 | 5/1986 | Igel | 57/281 |
| 4,650,062 | 3/1987 | Uchida | 198/468.6 |
| 4,683,713 | 8/1987 | Matsui et al. | 57/281 |
| 4,771,597 | 9/1988 | Igel et al. | 57/281 X |
| 4,805,352 | 2/1989 | Grassle et al. | 57/281 X |
| 4,810,155 | 3/1989 | D'Agnolo | 414/398 |
| 4,827,709 | 5/1989 | Schoeller et al. | 57/281 |
| 4,897,991 | 2/1990 | Rohner et al. | 57/281 |
| 4,923,132 | 5/1990 | Hirai et al. | 242/35.5 A |

FOREIGN PATENT DOCUMENTS

| | | |
|---|---|---|
| 1510763 | 9/1970 | Fed. Rep. of Germany . |
| 2227105 | 12/1973 | Fed. Rep. of Germany . |
| 2242361 | 1/1974 | Fed. Rep. of Germany . |
| 2347926 | 4/1975 | Fed. Rep. of Germany . |
| 2138926 | 3/1979 | Fed. Rep. of Germany . |

*Primary Examiner*—Robert J. Spar
*Assistant Examiner*—Robert S. Katz
*Attorney, Agent, or Firm*—Shefte, Pinckney & Sawyer

[57] ABSTRACT

A system for transferring bobbins between textile machines includes a temporary storage device positionable at a location between two textile machines for temporarily storing bobbins being transported between the machine. A transport rail assembly has either one rail extending between the machines for transport of bobbins either directly between machines or between the rail and the intermediate storage device, or a pair of rails each extending from one of the machines to the storage device. The storage device stores bobbins in a plurality of rows and is mobile for selective movement to other locations. It may have slidable pallet members for supporting bobbins or outwardly projecting support members inclined in the range of horizontal to vertically upward for supporting bobbins inserted thereon. The storage device further includes at least one component shaped compatible with the rail for facilitating transfer of bobbins and the component can be selectively movable vertically with respect to the rail for transfer of bobbins supported on the device in rows. The rail assembly may include at least one branch rail selectively movable with respect to the storage device, which may include a plurality of pairs of rails for suspension of bobbins thereon.

5 Claims, 8 Drawing Sheets

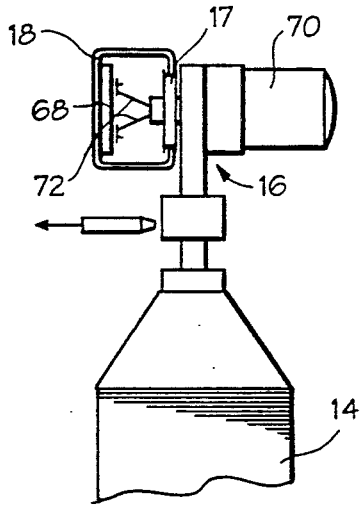
Fig.11
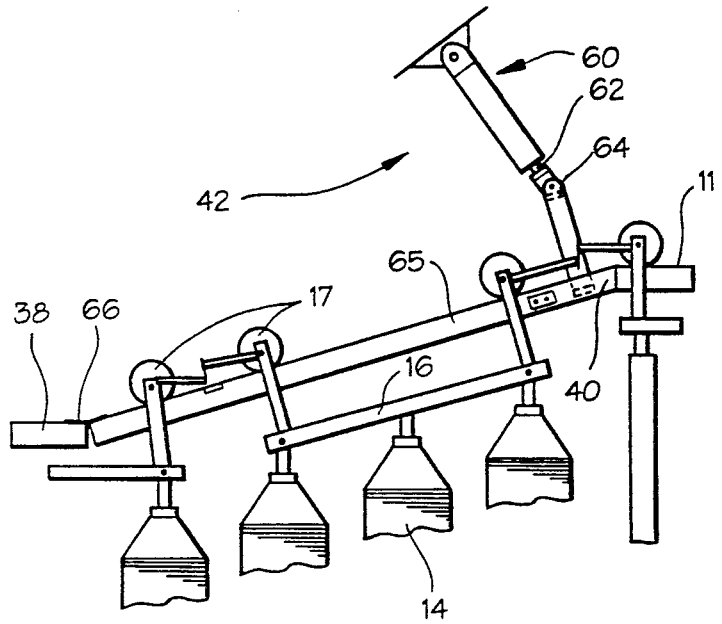
Fig.12
Fig.13
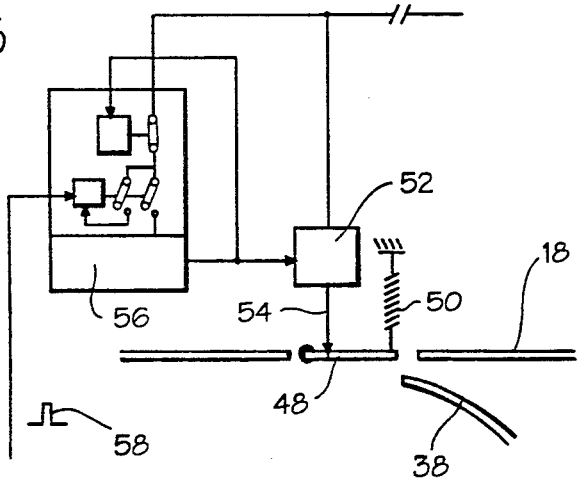

SYSTEM FOR TRANSPORTING BOBBINS BETWEEN SPINNING MACHINES

This is a continuation-in-part of copending application Ser. No. 07/572,346, filed Aug. 23, 1990, now abandoned, which is a continuation of Ser. No. 07/254,469, filed Oct. 6, 1988 now abandoned.

BACKGROUND OF THE INVENTION

The present invention relates to a system for transporting bobbins between yarn processing machines, and more particularly to a system for transporting bobbins between two machines in combination with a device between the machines for temporarily storing bobbins during transfer.

Transport systems are known for transporting bobbins between textile machines and are known to include temporary storage means to accumulate the supply of bobbins and thereby maintain a supply during temporary fluctuations in the production rates of the machines. For example, German Patent document A 22 27 105 discloses a system for transporting bobbins between a plurality of fly frames and a relatively much larger plurality of ring spinning machines. More specifically, the disclosed transport system transports full bobbins from the fly frames to the ring spinning machines and returns empty bobbins from the ring spinning machines to the fly frames. The disclosed transport system can be provided with a storage apparatus positioned adjacent the longitudinal ends of the ring spinning machines to serve as temporary storage for the bobbins during their travel between the fly frames and the ring spinning machines. The storage apparatus consists of a plurality of parallel oriented rails or tracks on to which the bobbins are transferred. However, these storage apparatus rails, on which the bobbins can be temporarily stored, require a considerable amount of additional track lengths and, oftentimes, the space requirements of these temporary storage rails exceed the space available in the areas adjacent the ring spinning machines.

Accordingly, the need exists for a transport system for bobbins for transporting bobbins to and from temporary storage apparatus positioned between textile processing machines.

SUMMARY OF THE INVENTION

The system of the present invention facilitates and minimizes the space requirements for the transfer and temporary storage of bobbins between machines. Briefly described, the system for transporting bobbins or the like between two yarn processing machines according to the present invention includes a unitary storage device for temporarily storing bobbins between the machines. This device has bobbin support members arranged thereon for supporting bobbins in a plurality of rows. The system also includes a bobbin transporting rail extending from at least one of the machines to the storage device for positioning bobbins between the one machine and a position at the location of the storage device for transferring bobbins between the rail and the bobbin storage device.

The bobbin transporting rail in one embodiment extends between one machine and the bobbin storing device, in another embodiment a rail extends from one machine to the other machine and may be used alternatively for transporting bobbins between the machines and the bobbin storage device or directly between the machines, and in a further embodiment one rail extends from one machine to the bobbin storage device and another rail extends from the other machine to the bobbin storage device and the system can be used for transferring bobbins between the machines and the bobbin storage device or alternatively for transferring bobbins from one rail to the other for directly transporting bobbins between the machines.

The bobbin storage device is preferably mobile for selective movement to other locations for loading and unloading bobbins therefrom. Also preferably the bobbin storage device has at least one component shaped compatible with the shape of the bobbin transporting rail for facilitating the transfer of bobbins from the rail to the bobbin storage device. For this purpose, the bobbin transporting rail may include at least one branch rail selectively movable to a position aligned with the position of the storage device component, which may be selectively movable vertically.

Preferably, means are provided for transferring bobbins between the bobbin storage device and the bobbin transporting rail, and the bobbin storage device may include pallet members for storing bobbins thereon, which pallet members may be slidably mounted. In another embodiment the bobbin storage device has bobbin support members projecting outwardly at an inclination in the range of horizontal to vertically upward for supporting bobbins inserted thereon by the transferring means.

Other and further features and advantages of the present invention will be apparent from the accompanying drawings and the following detailed description of the preferred embodiments.

BRIEF DESCRIPTION OF THE DRAWINGS

FIG. 11 is a vertical sectional view of the continuous rail of the transport system shown in FIG. 10, as viewed in the direction XI—XI;

FIG. 12 is a side elevational view of a portion of a branch rail and a portion of the temporary storage device shown in FIG. 10; and FIG. 13 is an enlarged plan view of the detail XIII shown in FIG. 10.

DETAILED DESCRIPTION OF THE PREFERRED EMBODIMENTS

Figure 1:
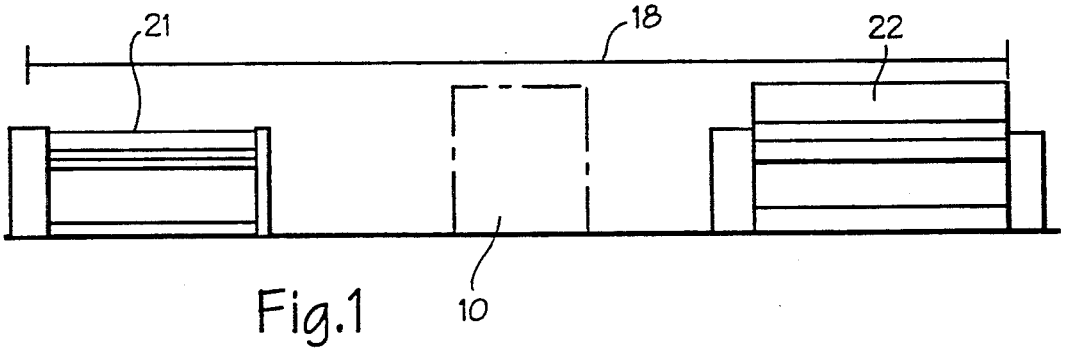
FIG. 1 is a schematic representation of a transport system according to one preferred embodiment of the present invention for transporting bobbins between a fly frame and a ring spinning machine, showing a continuous rail extending between the fly frame and the ring spinning machine on which bobbins are transported either directly between the two machines or from the machines to a temporary storage device positioned therebetween.

As shown in FIG. 1, the bobbin transporting system of one embodiment of the present invention includes a rail assembly 18 extending between a fly frame 21 and a ring spinning machine 22 for transporting empty or full bobbins to and from the fly frame 21 and the ring spinning machine 22 or to and from the fly frame or the ring spinning machine, and a unitary movable temporary storage device 10. The temporary storage device 10 includes means for storing a plurality of bobbins next to and above one another so that the storage apparatus has large storage capacity while occupying a relatively small floor space.

The rail assembly 18 is of the conventionally known rail type in which the bobbins are supported on bobbin holders movable along a rail or rails extending between the fly frame 21 and the ring spinning machine 22.

Figure 2:
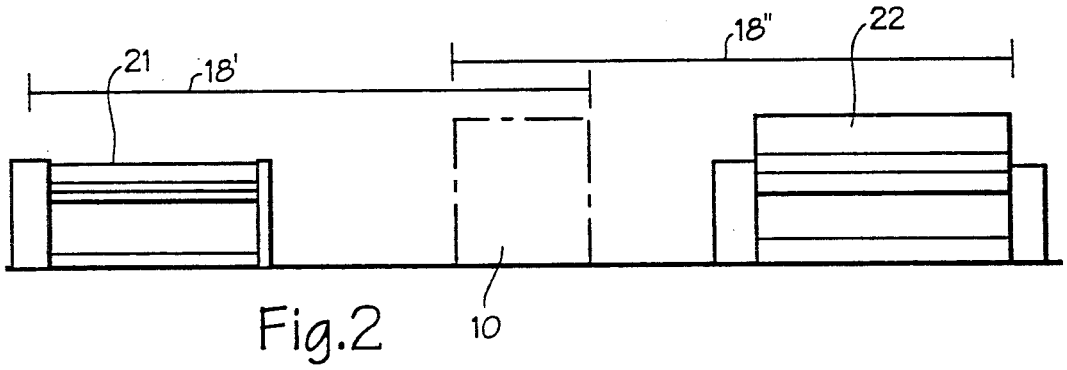
FIG. 2 is a schematic representation similar to FIG. 1 except that the fly frame and the ring spinning machine are each serviced by a separate rail extending from the respective machine to a position adjacent the temporary storage device.

In the embodiment illustrated in FIG. 2, instead of the continuous rail extending between the fly frame 21 and the ring spinning machine 22 as illustrated in FIG. 1, the rail assembly 18 includes a first rail portion 18' extending from the fly frame 21 to an intermediate location, such as adjacent a mid-point between the fly frame 21 and the ring spinning machine 22 at which location the temporary storage device 10 is parked. Additionally, the rail assembly 18 includes a second rail portion 18" which extends from the ring spinning machine 22 to the location of temporary storage device 10 where the two rail portions 18', 18" overlap. Full bobbins from the fly frame 21 are transported along the first rail portion 18' to the temporary storage device 10 and empty bobbins temporarily stored in the temporary storage device 10 are transported along the same portion 18' to the fly frame 21. Full bobbins temporarily stored in the temporary storage device 10 are transported along the second rail portion 18" to the ring spinning machine 22 and empty bobbins from the ring spinning machine 22 are transported to the temporary storage apparatus 10 for temporary storage therein.

Figure 3:
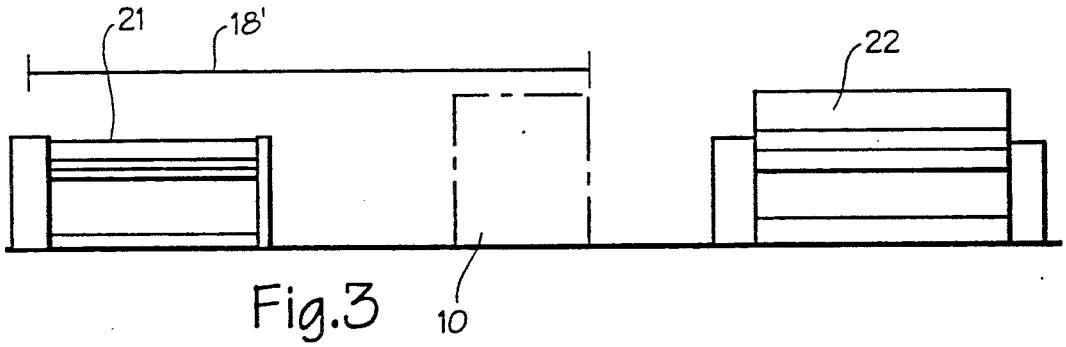
FIG. 3 is a schematic representation similar to FIG. 1 except that the fly frame is serviced by a rail extending to the temporary storage device and the temporary storage device is movable between a position between the fly frame and the ring spinning machine and the ring spinning machine.

In the further embodiment illustrated in FIG. 3, the rail assembly 18 includes a first portion 18' extending from the fly frame 21 to the intermediate location of the temporary storage device 10 and the temporary storage device 10 is movable to a position adjacent the ring spinning machine 22 to transfer full bobbins to the ring spinning machine and to receive empty bobbins from the ring spinning machine, and is movable to its intermediate location at which empty bobbins stored therein can be transferred to the first rail portion 18' for transport to the fly frame 21 and full bobbins from the fly frame 21 transported along the first rail portion 18' can be transferred thereto.

Figure 4:
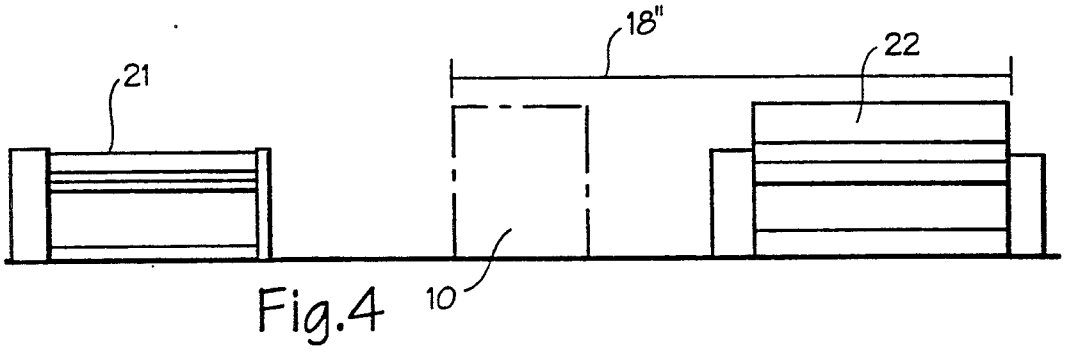
FIG. 4 is a schematic representation similar to FIG. 1 except that the ring spinning machine is serviced by a rail extending to the temporary storage device and the temporary storage device is movable between a position between the fly frame and the ring spinning machine and the fly frame.

In the embodiment shown in FIG. 4, the rail assembly 18 includes the second rail portion 18" extending from the ring spinning machine to the intermediate location of the temporary storage device 10. In this embodiment, the temporary storage device 10 is movable to the intermediate location and a location adjacent the fly frame 21 at which empty bobbins stored in the temporary storage device can be transferred to the fly frame 21 and full bobbins from the fly frame can be transferred to the temporary storage device 10 for temporary storage therein.

The embodiments illustrated in FIGS. 1–4 illustrate different configurations of the rail assembly 18 which can be used in the bobbin transport system of the present invention in lieu of the branch rail-type system disclosed, for example, in the German Patent No. A 22 27 105. Additionally, the rail assembly 18 can be modified to include branch rails adjacent the respective machines in which one or several rows of bobbins can be supported temporarily next to the machine until they are transferred to the machine. In light of the practical knowledge conventionally known about the temporary storage of bobbins adjacent textile machines, rails having means movable therealong for suspending bobbins therefrom are preferred for such storage. Additionally, these branch rail assemblies are preferably positioned in the region of the spare bobbin frame of the ring spinning machine itself.

Figure 5:
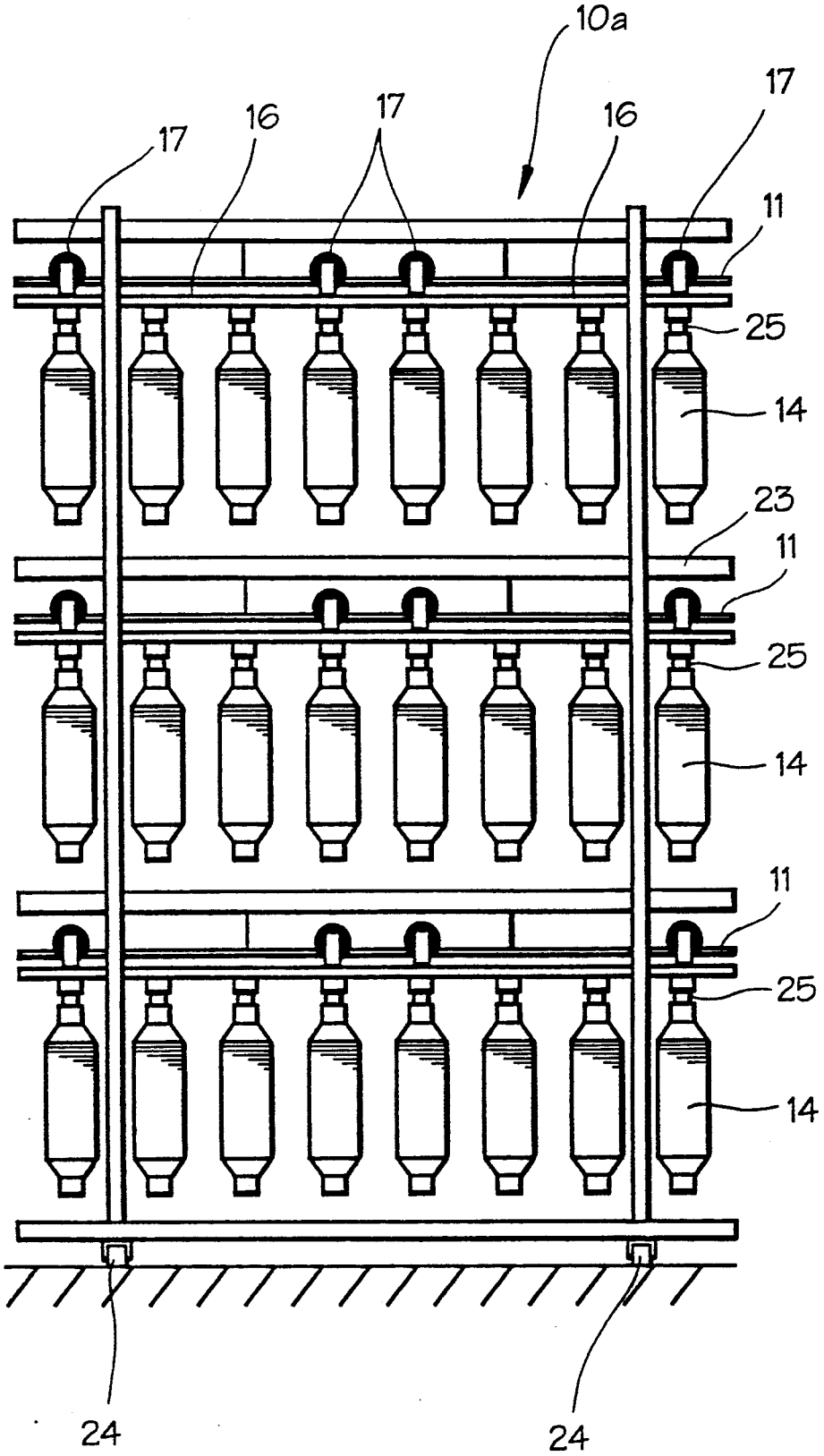
FIG. 5 is a front elevational view of one form of a temporary storage device included in a bobbin transporting system of the present invention.
Figure 6:
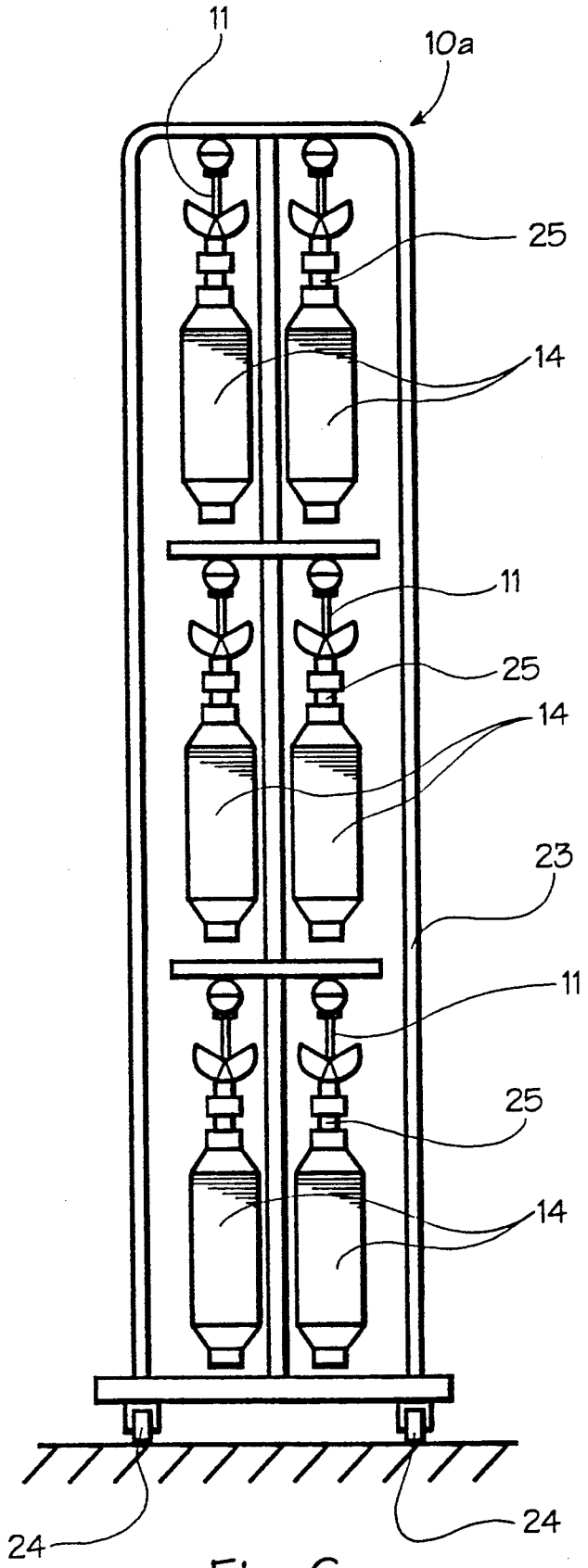
FIG. 6 is an end elevational view of the temporary storage device shown in FIG. 5.

In FIGS. 5 and 6, a temporary storage device **10*a* of a form utilized in the present invention is seen to include a rack 23 mounted on rollers 24 on which the temporary storage device 10*a* rolls on a surface such as a floor. The rack 23 includes a plurality of rails 11 arranged in pairs parallel to one another, with each respective pair of rails being vertically spaced from and aligned with the other pairs of rails. Preferably, the rails of each rail pair are spaced from one another at the same spacing at which a pair of rails of the rail assembly 18 are spaced from one another. A segment 16 having a plurality of creels 25 mounted thereto at uniform intervals for supporting bobbins thereon, is suspended from each of the rails 11 by a pair of spaced rail wheel assemblies 17 having grooved wheels which engage and roll along the rails 11**.

Figure 10:
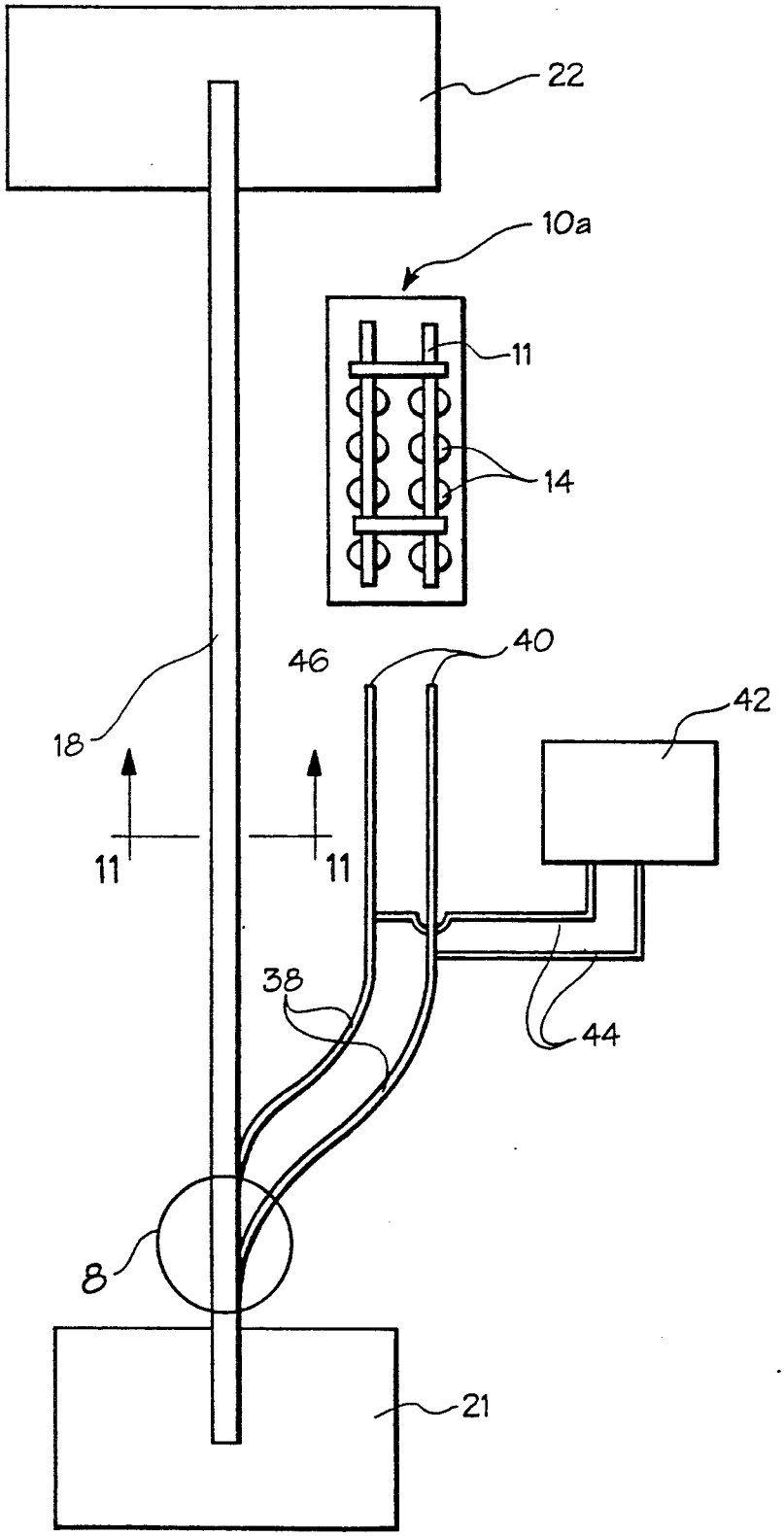
FIG. 10 is a plan view of the transport system shown in FIG. 1.

In the embodiment illustrated in FIG. 10, the rail assembly 18 includes a pair of branch rails 38 selectively aligned with a conventional switch to the rail of the rail assembly 18. Each branch rail 38 is operatively connected to an alignment controller 42 by an arm 44. The alignment controller 42 has a controllable mechanism of conventional type, such as a mechanical drive apparatus, for moving the arms 44 to thereby move the free ends 40 of the branch rails 38. By selective movement of the free ends 40, the branch rails 38 can be raised, lowered and moved side to side to bring their free ends into alignment with the free ends 46 of rail 11 of the bobbin storage device **10*a* of FIGS. 5 and 6. Once the free ends 46 of the rails 11 and the free ends 40 of the branch rails 38 have been brought into alignment with each other, the bobbins 14 supported on the rails 11 can be moved onto the branch rails 38 and then moved along these rails to the main rail of the assembly 18 for further transport to the fly frame 21 or the spinning machine 22**.

Figure 7:
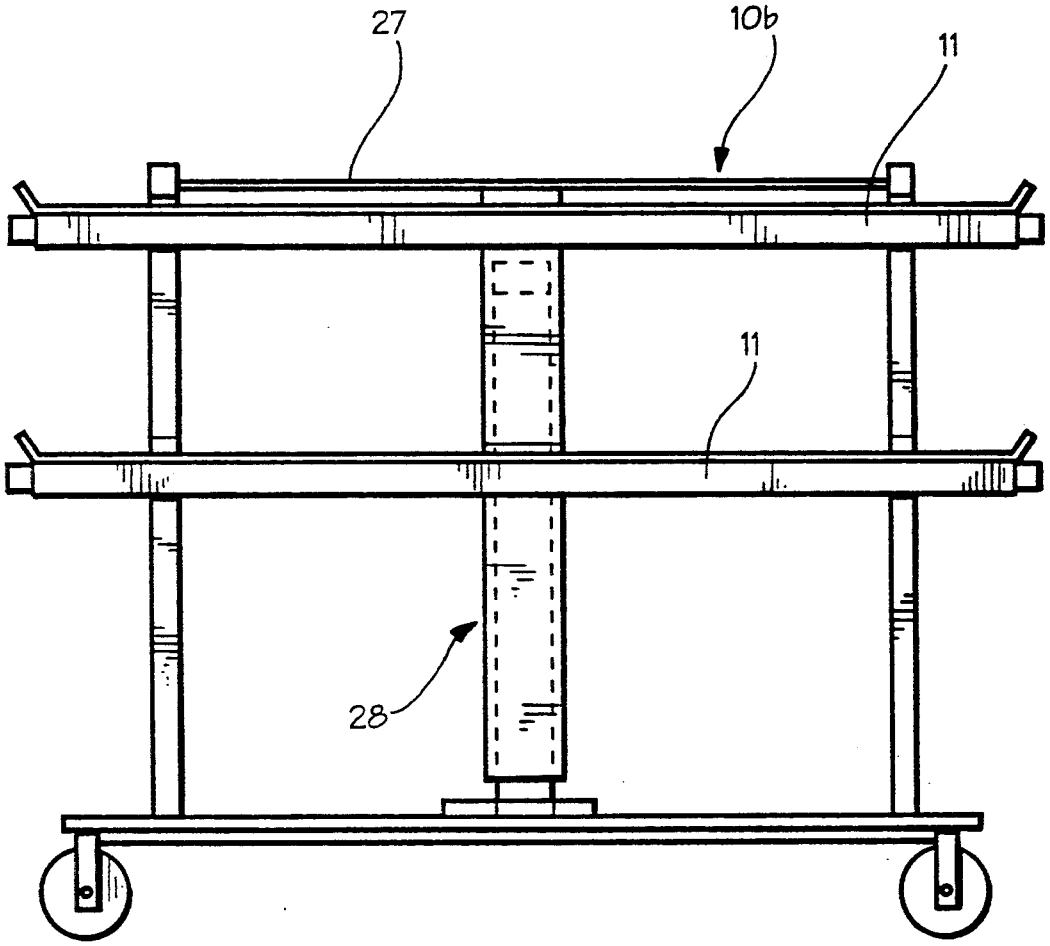
FIG. 7 is a front elevational view of another form of a temporary storage device of the present invention.

In the form illustrated in FIG. 7, a temporary storage device **10*b* includes two pairs of rails 11 mounted on a rack 27. The rails 11 can be provided with the segments and corresponding rollers for supporting bobbins as described with respect to the embodiment of FIGS. 5 and 6. The temporary storage device 10***b* includes a conventional vertical movement apparatus 28 such as, for example, an hydraulic or pneumatic cylinder with a piston extendable and retractable therein, which is connected to the rails 11 for raising and lowering the rails 11 as required to bring each pair of rails 11 into alignment with the corresponding branch rails of the rail assembly.

Figure 8:
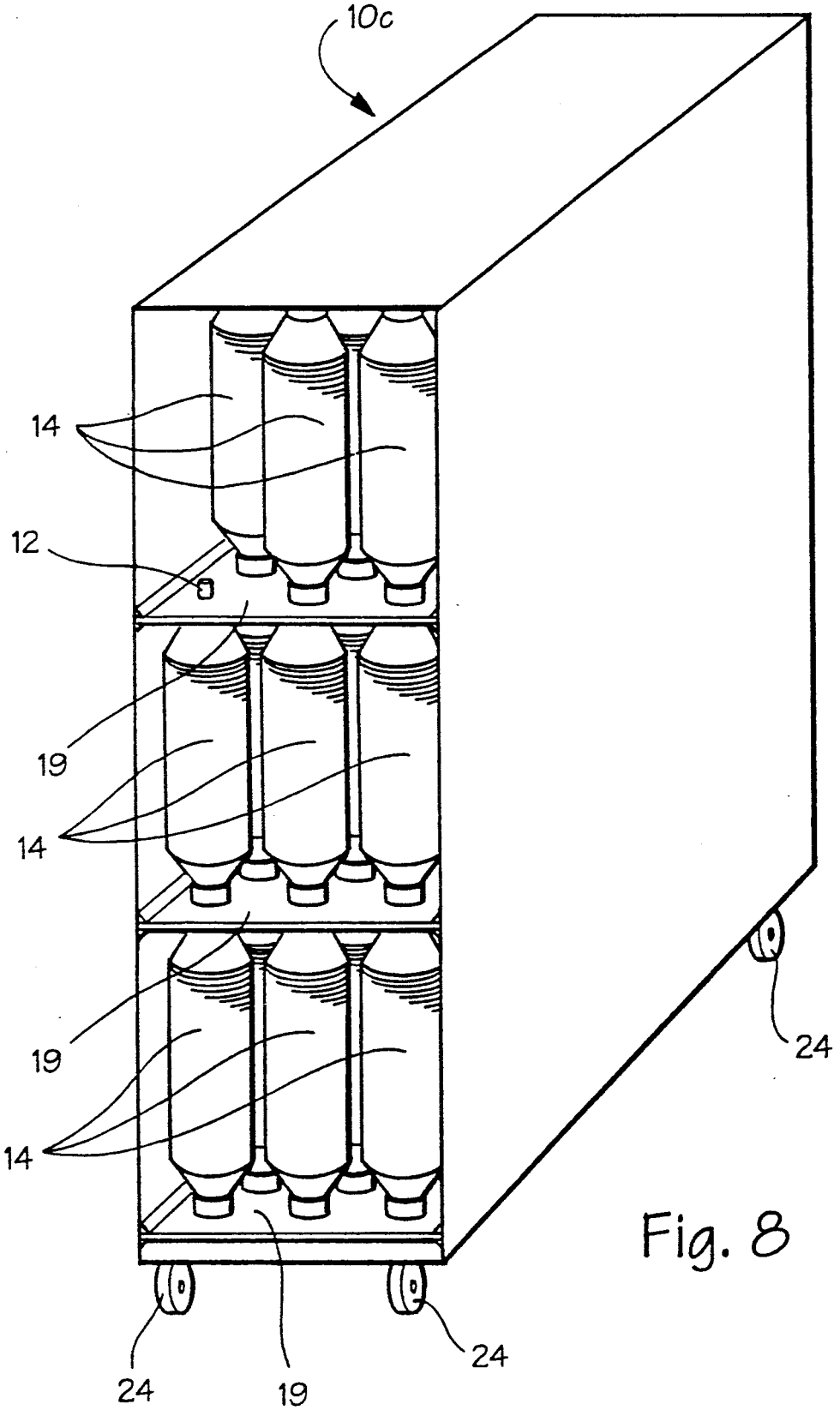
FIG. 8 is a perspective view of a further form of a temporary storage device of the present invention.

In a further form illustrated in FIG. 8, a temporary storage device 10*c* is in the form of a mobile unit mounted on a plurality of rollers 24. The unit includes mounting means for mounting a plurality of slidable drawer-like pallets 19, each of which is provided with means 12 such as, for example, posts, for supporting bobbins thereon. The pallets 19 can accommodate a relatively large of bobbins 14 in a relatively small amount of floor space. The pallets 19 can be inserted and withdrawn from the unit of the temporary storage device 10*c* as required to load or unload the bobbins 14 thereon. The temporary storage device 10*c* can be provided with a transfer apparatus for transferring the bobbins 14 from the apparatus to a textile processing machine, such as the ring spinning machine 22.

Figure 9:
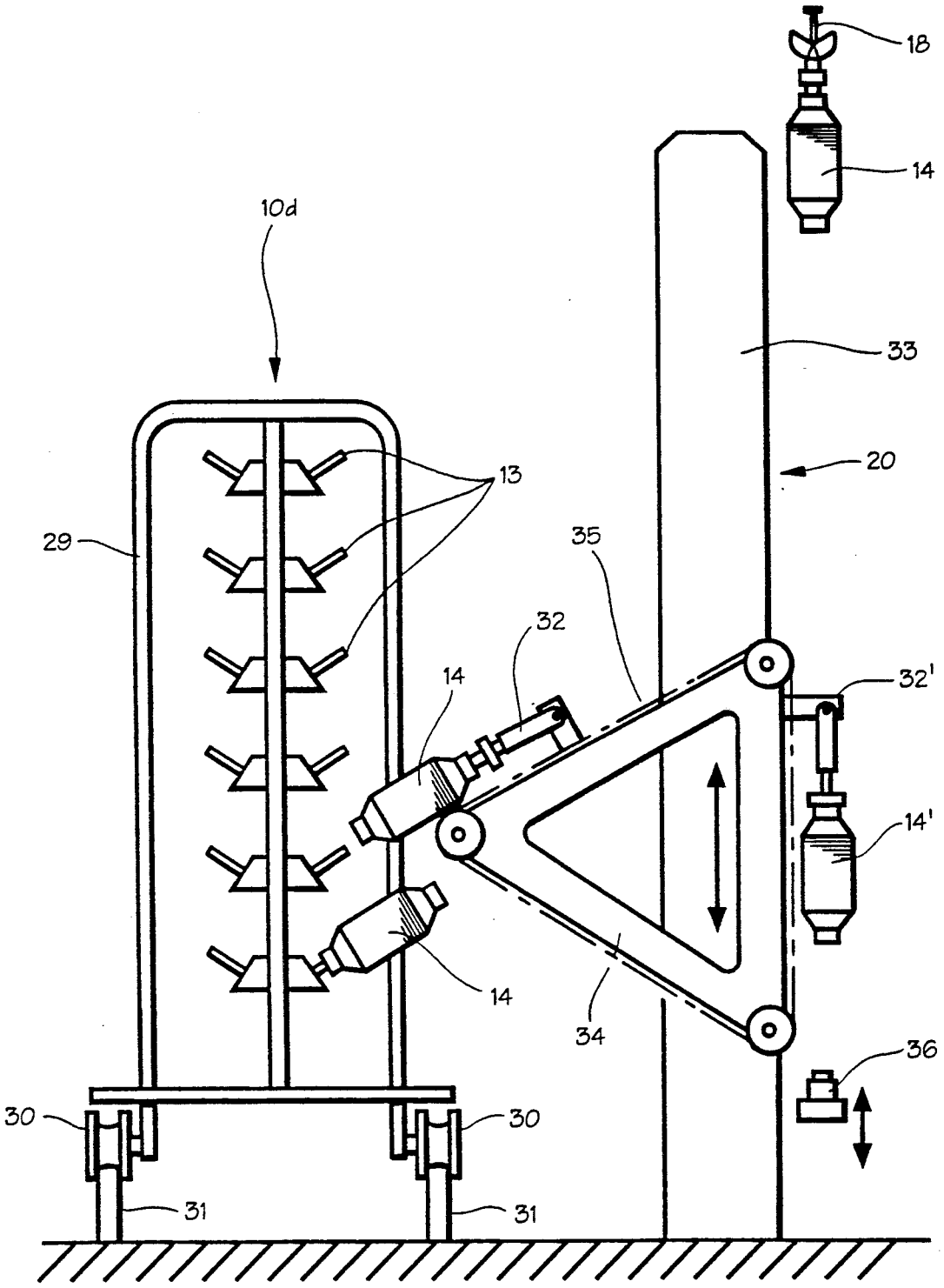
FIG. 9 is an end elevational view of yet another temporary storage device and a vertical transfer apparatus of the present invention.

Another form of the bobbin storage device of the present invention is illustrated in FIG. 9 and in this form the device 10*d* has a plurality of bobbin support members or posts 13 arranged in horizontal rows and supported on a rack 29. The posts 13 are upwardly oriented and are adapted to receive bobbins 14 inserted thereon. The posts 13 may project outwardly at an inclination in the range of horizontal to vertically upward as desired for preferred support of bobbins inserted thereon. The frame 29 includes a plurality of grooved wheels 30 which roll along a pair of spaced parallel stationary rails 31 mounted on the floor.

In each of the forms described, the bobbin storage device is a unitary device separate from the rails for independent accumulation of bobbins from the rails without being limited by the rails in capacity and floor space. Further, all forms of the device include bobbin supporting members arranged for supporting bobbins in a plurality of rows for compactness in storing a large number of bobbins in a small floor space as compared with a conventional branch rail system of storing bobbins.

In addition, the bobbin storage devices 10, 10*a*, 10*b*, 10*c* and 10*d* are mobile independent of the rail assembly so that, if desired, the device can be moved to either of the machines for delivering or receiving bobbins or can be moved to other locations for receiving or delivering bobbins.

As illustrated in FIG. 9, the system of the preferred embodiment of the present invention also includes a transfer means 20 for transferring bobbins 14 from the temporary storage devices 10, 10*a*, 10*b*, 10*c* or 10*d* to a rail of the rail assembly 18 and for transferring bobbins from the rail assembly 18 to the temporary storage device. The transfer means 20 includes a vertical column 33 along which a triangular carriage 34 is vertically movable. The carriage 34 includes an endless belt 35 trained around a plurality of guide rollers and a drive roller. A bobbin gripper 32 is fixedly mounted to the endless belt 35 and includes a grip arm mounted for rotation about an axis transverse to the direction of movement of the bobbin gripper 32 by the endless belt 35. The gripper arm of the bobbin gripper 32 can thus grip a bobbin 14 and transport along a surface of the triangular carriage that has been aligned with an inclined post 13 of the storage device 10*d* for insertion of the bobbin onto the post 13. Similarly, the carriage can be manipulated to remove bobbins from the carriage 10*d*. Additionally, the grip arm can be pivoted about the axis to orient the non-engaged end of the bobbin for engagement by a vertically movable grip element 36 which is mounted for vertical movement on the column 33. As illustrated in FIG. 9, a bobbin gripper 32' gripping a bobbin 14' holds the bobbin in a position for receipt by the vertical gripper 36. Once the bobbin 14' has been received on the vertical gripper 36, the bobbin gripper 32' can be moved by the endless belt to clear the bobbin and the vertical gripper. Then, the vertical gripper 36 can raise the bobbin 14' for insertion onto a creel on the transport assembly 18. In one modification of the embodiment shown in FIG. 9, the transfer means 20 can be provided with a plurality of bobbin grippers 32 and vertical grippers 36 so that a horizontal row of bobbins 14 on the temporary storage device 10*d* can be simultaneously transferred therefrom.

The system of the present invention, in addition to being capable of transporting bobbins between the storage device and the machines, is capable of selectively alternatively transporting bobbins directly between machines without temporary storing in the bobbin storage device. Thus, bobbins can alternatively be transported directly between machines with the single rail of FIG. 1, or they can be transferred from one rail to the other of FIG. 2 without transfer to the bobbin storage device.

ENCLOSURE I

With reference now to FIG. 10, the branch rails of the transport assembly 18 will be further described. A pair of branch rails 38 are selectively couplable by a conventional switch to the rail of the transport assembly 18 which extends from a position adjacent the fly frame 21 to a position adjacent the spinning machine 22. The free end 40 of each branch rail 38 is movable by means of an alignment controller 42 which is operatively connected to the branch rails by arms 44. The alignment controller 42 is operatively connected to a horizontal adjustment device, illustrated in FIG. 13, and a vertical adjustment device, illustrated in FIG. 12, for horizontally and vertically moving the branch rails 38 to configure the transport assembly 18 for the rolling travel of the segments 16 between the temporary storage device 10*a* and the rails of the transport assembly 18. The alignment controller 42 moves the free ends 40 into alignment with the free ends 46 of the rails 11 of the storage apparatus 10*a* so that the bobbins 14 supported on the rails 11 can be transferred to support means on the branch rails 38. Once the bobbins 14 have been transferred to the branch rails 38, they can be moved to the rails of the transport assembly 18 for further transport to the fly frame 21, the spinning machine 22, or some other location for handling the bobbins.

In the embodiment illustrated in FIGS. 10–13, the rail assembly 18 additionally includes a pair of branch rails 38 each extending from the primary rail (the rail extending between the fly frame 21 and the ring spinning machine 22) to the same respective lateral side thereof. As seen in FIG. 13, each branch rail 38 is selectively connectable to the primary rail of the rail assembly 18 for rolling travel of the segments 16 therebetween. One end of each branch rail 38 terminates relatively adjacent the primary rail of the rail assembly 18 and each branch rail 38 extends generally at an acute angle with respect to the longitudinal extent of the rail of the rail assembly 18.

A portion of the primary rail of the rail assembly 18 is formed by a pair of switch rails 48. As seen in FIG. 13, each switch rail 48 has a free end pivotally mounted to the frame supporting the rail assembly 18 for pivoting about a vertical axis extending through the path of travel of the segments 16 along the primary rail of the rail assembly 18. The other free end of the switch rail 48 is connected to the free end of a biasing member 50, which can be in the form of a conventional spring. The other end of the biasing member 50 is mounted to a support frame.

Each switch rail 48 is disposed for selectively interconnecting the primary rail and a respective branch rail 38. A conventional selective movement means in the form of a conventional solenoid assembly 52 includes a selectively extendable and retractable plunger 54 whose free end is pivotally connected to the switch rail 48 at a spacing from the pivot axis of the switch rail. The solenoid assembly 52 is actuable to extend the plunger 54 to effect pivoting of the switch rail 48 from a primary rail transport position in which the longitudinal extent of the switch rail is in alignment with the longitudinal extent of the primary rail for linear travel of the segments 16 along the switch rail 48 and the portions of the primary rail adjacent each end of the switch rail 48, and a branch rail connecting position in which the switch rail 48 has been pivoted about its pivot axis to bring its free end into aligned, adjacent relation with the adjacent free end of the respective branch rail 38 for rolling travel of the segments 16 from the primary rail of the rail assembly 18, along the switch rail 48 and onto the respective branch rail 38 to effect transfer of the bobbins 14 from the primary rail of the rail assembly 18 to the respective branch rail 38.

The solenoid assembly 52 is operatively connected to a conventional solenoid control device 56 which includes a sensor 58 for sensing the travel therepast of a segment 16 along the rail of the rail assembly 18. The sensor 58 can be in the form, for example, of a light emitting component for emitting a light beam transversely across the travel path of the primary rail and a photo detecting component disposed for detecting interruption of the light beam. The sensor 58 is positioned relatively adjacent the primary rail at a location intermediate the switch rail 48 and the fly frame 21. The conventional solenoid control device 56 can be configured to actuate the solenoid 52 to effect movement of the switch rail 48 between its main transport position and its branch rail connecting position in response to the sensing by the sensor 58 of a segment 16 traveling therepast.

As seen in FIG. 10, each branch rail 38 initially extends from its end adjacent the primary rail in a generally curved configuration and then extends in a generally linear extent to a free end 40.

An alignment controller 42 is provided for selectively vertically moving the end 40 of each branch rail 38. As seen in FIG. 12, the alignment controller 42 includes a pair of conventional pneumatic cylinder and piston assemblies, each having a cylinder 60 pivotally connected at one end to a frame member and a piston 62 selectively extendable from, and retractable into, the cylinder 60. The free end of the piston 62 is pivotally connected to an arm 64 rigidly connected to the free end 40 of a respective one of the branch rails 38. The arm 64 extends transversely from the branch rail 38 relative to the longitudinal extent of the rail in a generally vertical direction. A pivot portion 65 of the linear extent of the branch rail 38 forming the free end 40 thereof is pivotally connected by a pivot connector 66 to the remainder of the linear extent of the branch rail 38. The pivot connector 66 permits pivotal movement of the free end 40 of the branch rail 38 relative to extent about a generally horizontal axis transverse to the linear extent of the branch rail. The arm 64 is rigidly connected to the branch rail 38 at a location intermediate the pivot axis and the free end 40 of the branch rail 38.

The cylinder 60 is connected to a conventional pneumatic fluid source (not shown) for supply of pneumatic fluid to the cylinder 60 and for the receipt of pneumatic fluid discharged from the cylinder 60. Each alignment controller 42 is operable as follows to effect vertical alignment of a free end 40 of a selected one of the branch rails 38 with a respective one of the rails 11 of the temporary storage apparatus 10*a*. If the free end 40 of the branch rail 38 is lower than the respective rail 11, the conventional pneumatic fluid source is manually or automatically controlled to supply pneumatic fluid to, and receive pneumatic fluid from, the cylinder 60 to effect retraction of the piston 62 into the cylinder 60. The retraction of the piston 62 effects pivoting of the pivot portion 65 of the respective branch rail 38 about the pivot axis of the pivot connector 66 with corresponding vertical displacement of the free end 40 of the branch rail 38. The conventional pneumatic fluid source is controlled as appropriate to effect positioning of the free end 40 of the branch rail 38 at generally the same height as the respective rail 11 to which the bobbins 14 transported along the branch rail 38 are to be delivered. The operator then manipulates the temporary storage apparatus 10*a* as necessary to dispose the free end of the respective rail 11 in substantially abutting engagement with the free end 40 of the branch rail 38.

If the free end 40 of the branch rail 38 is higher than the respective rail 11 of the temporary storage apparatus 10*a*, the conventional pneumatic fluid source is manually or automatically controlled to supply pneumatic fluid to, and receive pneumatic fluid from, the cylinder 60 to effect extension of the piston 62 from the cylinder 60. The pivot portion 65 of the respective branch rail 38 pivots about the axis of the pivot connector 66 in correspondence with the extension of the piston 62, thereby correspondingly moving the free end 40 of the branch rail 38 to a lower position generally at the same height as the respective rail 11 of the temporary storage apparatus 10*a*. The operator then manipulates the temporary storage apparatus 10*a* as necessary to move the free end of the respective rail 11 into substantially abutting engagement with the free end 40 of the branch rail 38.

As seen in FIG. 11, the primary rail of the rail assembly 18 is in the form of a generally C-shaped channel having a pair of opposed, parallel longitudinal edges. The wheel of each spaced wheel assembly 17 is in the form of a pulley or grooved-type wheel having an inner circumferential surface of reduced extent formed intermediately a pair of flanged portions of relatively larger circumferential extent.

The opposed, parallel longitudinal edges of the C-shaped channel are uniformly spaced from one another at a spacing slightly larger than the diameter of the inner reduced circumferential portion of the wheels of the wheel assemblies 17 and of lesser extent than the diametrical extent of flange portions of the wheels of the wheel assemblies 17 for movably retaining the wheels of the wheel assemblies 17 therebetween during rolling travel of the segments 16 along the rail of the rail assembly 18.

The primary rail of the rail assembly 18 includes an electrical conducting strip 68 mounted to the inner surface of the side of the C-shaped channel which is opposite the opening formed by the opposed, parallel longitudinal edges. The electrical conducting strip 68 is operatively connected to a conventional electrical supply source (not shown) for supplying electrical current along the extent of the electrical conducting strip 68. The electrical conducting strip 68 is co-extensive with the primary rail of the rail assembly 18. Each segment 16 includes a conventional electric drive motor 70 having a drive shaft on which a respective one of the wheel assemblies 17 of the respective segment 16 is fixedly mounted. The electric drive motor 70 includes a pair of current collecting fingers 72 mounted to the drive shaft of the electric drive motor. The free ends of the current collecting fingers 72 are supported relative to the electrical conducting strip 68 for conducting electrical current from the electrical conducting strip to the electric drive motors 70.

The electric drive motor 70 rotates the wheel of the respective wheel assembly 17 in response to the flow of the electric current in the electrical conducting strip 68. The direction of rotation of the drive shaft of the electric drive motor 70 can be selectively adjusted in conventional manner to effect rolling travel of the wheels of the wheel assemblies 17 along the rail of the rail assembly. For example, the electric drive motor 70 can be a direct current electric motor which rotates its drive shaft in one direction in response to a positive flow of electrical current through the electrical conducting strip 68 and reversibly rotates the drive shaft in an opposite rotating direction in response to the flow of negative current through the electrical conducting strip 68.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A system for transporting bobbins between two yarn processing machines comprising:

a unitary storage device for temporarily storing bobbins which have been processed by one of the yarn processing machines and are awaiting processing by the other yarn processing machine, said unitary storage device including at least two storage rails, said at least two storage rails each being fixedly mounted to said unitary storage device, each storage rail for supporting a plurality of bobbins in a row and said storage rails being arranged relative to one another to support said rows of bobbins in generally superposed vertical relation with one another, said unitary storage device having wheels operable to support said unitary storage device on a floor for rolling movement therealong to allow selective movement of said unitary storage device between a transfer location for loading bobbins onto said storage rails and another location for unloading bobbins from said storage rails;

a bobbin transporting rail extending from at least one of the yarn processing machines to said transfer location; and rail movable support means having wheel means for rolling travel along said storage rails and said bobbin transporting rail, said rail movable support means for supporting a plurality of bobbins arranged in a row for movement of said row of bobbins as an integral unit, said rail movable support means being compatibly configured with said storage rails and said bobbin transporting rail to effect relative movement of said row of bobbins along a selected one of said storage rails while supported by said rail movable support means, said selected storage rail being supported by said unitary storage device at said transfer location for rail-to-rail bridging movement of said rail movable support means between said selected storage rail and said bobbin transporting rail to effect groupwise transfer of said row of bobbins between said unitary storage device and said bobbin transporting rail.

2. A system for transporting bobbins between two yarn processing machines according to claim 1 and characterized further in that said bobbin transporting rail extends from each of the yarn processing machines to said transfer location.

3. A system for transporting bobbins between two yarn processing machines according to claim 1 wherein one of the yarn processing machines is a fly frame and characterized further in that said bobbin transporting rail extends from the fly frame to said transfer location.

4. A system for transporting bobbins between two yarn processing machines according to claim 1 wherein one of the yarn processing machines is a ring spinning machine and characterized further in that said bobbin transporting rail extends from the ring spinning machine to said transfer location.

5. A system for transporting bobbins between two yarn processing machines according to claim 1 and characterized further in that said bobbin transporting rail extends from one of the yarn processing machines to said transfer location and a second bobbin transporting rail extends from the other yarn processing machine to said transfer location and said unitary storage device supports said selected storage rail at said transfer location for rail-to-rail bridging movement of said rail movable support means between said selected storage rail and a respective one of said bobbin transporting rail and said second bobbin transporting rail to effect groupwise transfer of said row of bobbins between said unitary storage device and said respective one bobbin transporting rail.

* * * * *